US007217198B2

(12) United States Patent
Brooks

(10) Patent No.: US 7,217,198 B2
(45) Date of Patent: May 15, 2007

(54) GOLF PUTTING PRACTICE AID

(76) Inventor: Roger J. Brooks, 7 Airedale, Galgate, Lancaster (GB) LA2 0RR ( * ) Notice: Subject to any disclaimer, the term of this patent is extended or adjusted under 35 U.S.C. 154(b) by 0 days.

(21) Appl. No.: 10/333,047

(22) PCT Filed: Jul. 13, 2001

(86) PCT No.: PCT/GB01/03171

§ 371 (c)(1),
(2), (4) Date: May 5, 2003

(87) PCT Pub. No.: WO02/05905

PCT Pub. Date: Jan. 24, 2002

(65) Prior Publication Data

US 2003/0162601 A1 Aug. 28, 2003

(30) Foreign Application Priority Data

Jul. 15, 2000 (GB) ..... 0017322.9
Apr. 6, 2001 (GB) ..... 0108704.8

(51) Int. Cl.
*A63B 69/36* (2006.01)

(52) U.S. Cl. ..... 473/260; 473/261

(58) Field of Classification Search ..... 473/257, 473/261, 258, 278, 279, 219, 260; 33/538, 33/534; 16/342
See application file for complete search history.

(56) References Cited

U.S. PATENT DOCUMENTS 2,776,836 A * 1/1957 Zadina ..... 473/226
2,866,645 A * 12/1958 Cayot ..... 473/260
4,453,717 A 6/1984 Solheim et al.
4,900,030 A 2/1990 Houtz
4,928,975 A 5/1990 Skelley et al.
5,007,646 A * 4/1991 Baber et al. ..... 473/261
5,024,442 A 6/1991 Sindelar, Sr.
5,131,659 A 7/1992 Lindberg, Jr.
5,150,904 A * 9/1992 Sindelar ..... 473/251
5,294,124 A * 3/1994 Florian ..... 473/267
5,362,057 A 11/1994 Arima
5,393,065 A * 2/1995 LeQuyea ..... 473/260
5,435,547 A 7/1995 Lee
5,443,265 A 8/1995 Wheeler
5,548,478 A * 8/1996 Kumar et al. ..... 361/681
5,586,941 A * 12/1996 Klearman ..... 473/160
6,159,106 A 12/2000 Adams
6,500,075 B1 * 12/2002 McDevitt ..... 473/272

(Continued)

FOREIGN PATENT DOCUMENTS

GB 301646 12/1928

(Continued)

*Primary Examiner*—Raleigh W. Chiu
(74) *Attorney, Agent, or Firm*—Ware, Fressola, Van der Sluys & Adolphson LLP

(57) ABSTRACT

A golf putting practice aid comprising a guide having a guide surface (3) with which a heel or the toe of a putter makes contact in use. The guide is positioned to extend upwardly from a substantially planar base or ground surface (1,100'). By making the guide surface straight throughout its length, and inclined towards the user, the surface will act to constrain the putter head to follow an inclined plane angled towards the user. By using a planar guide 3', a player can decide whether to have the toe or the heel of the putter guided thereby.

17 Claims, 5 Drawing Sheets

U.S. PATENT DOCUMENTS

| | | | | |
|---|---|---|---|---|
| 6,561,920 | B1 * | 5/2003 | Hamilton | 473/257 |
| 2002/0016213 | A1 * | 2/2002 | Templeton | 473/257 |
| 2003/0148815 | A1 * | 8/2003 | Swistock | 473/257 |
| 2003/0162601 | A1 * | 8/2003 | Brooks | 473/260 |

FOREIGN PATENT DOCUMENTS

| | | |
|---|---|---|
| GB | 2123302 | 2/1984 |
| GB | 2132490 | 7/1984 |
| GB | 2149673 | 6/1985 |
| GB | 2199754 | 7/1988 |
| GB | 2271722 | 4/1994 |
| GB | 2277272 | 10/1994 |
| GB | 2328618 | 3/1999 |
| WO | WO 83/03770 A1 | 11/1983 |

* cited by examiner

GOLF PUTTING PRACTICE AID

BACKGROUND OF THE INVENTION

1. Technical Field

The present invention relates to a golf putting practice aid.

2. Description of the Background Art

Putting is a very important element within the game of golf. Putting skill requires the ability to strike the ball in the correct direction with the appropriate force. Except for very short putts, the margin of error in the direction that the ball is struck in order to successfully hole a putt, for a given force of putt, is extremely small.

Many aids have been suggested in order to help golfers improve their putting skill. One approach used is to construct a device to restrict the movement of the putter to follow a particular path. The idea is that by moving the putter in such a restricted manner, the golfer is trained to move the putter in the same way when the device is removed.

One theory of putting is that the movement of the putter head in the horizontal direction should be along the line of the intended putt and that the face of the putter should be kept perpendicular to this line. Many inventions have been devised to constrain the head of the putter to move in such a way including GB 2328618 and GB 2271722. As a variation on this, GB 2199754 uses a pair of guides to achieve a back swing which is initially straight but then curves, and the forward stroke follows the same path.

GB 301646 is also designed to constrain the putter to move along the line of the putt. It uses a vertical guide for the toe of the putter and an angled guide for the heel or shaft of the putter. The inventor presumably assumes that the putter is moved parallel to the ground rather than following an arcuate path in the vertical direction. The angled guide preferably includes a lip to the upper end of the guide to act as an abutment to the putter shaft. The angled guide is adjustable to different putter lies.

SUMMARY OF THE INVENTION

However, as stated in U.S. Pat. No. 4,453,717, it is difficult and unnatural to swing the putter exactly along the line of the putt. In U.S. Pat. No. 4,453,717 a planar guide surface is set at an angle of 72° to the horizontal plane. This angle is the standard lie angle of the shaft of a putter. The golfer can engage the heel of the putter with the guide surface to train a stroke to follow this plane. The guide surface angle can also be changed to 90° by inserting a wedge in order to practice the putting method of swinging the putter head along the line of the putt.

U.S. Pat. No. 4,453,717 is based on the assumption that the correct plane angle for putting is the angle of the shaft of the club. I believe that this is incorrect. The method used and advocated by most professional golfers over the past 20 years or more is to swing the putter mainly by a rotation action of the shoulders. Therefore, I believe that the most natural plane angle for such a method is the angle from the ball to the midpoint between the shoulders, not the shaft lie angle. An important consequence is that this angle is not fixed but will vary for different golfers depending upon the posture adopted by the golfer when putting. The angle of this plane to the horizontal will also usually be greater than the putter shaft lie angle to the horizontal.

A further disadvantage of U.S. Pat. No. 4,453,717 and several other previous devices including GB 301646 is that the guide surface is provided for the heel of the putter. This means that if the guide surface is vertical, the shaft of the putter may contact the guide surface rather than the heel of the putter. Indeed, for putters in which the putter shaft is connected straight into the heel of the putter head, the shaft will contact the guide surface if the guide surface is at any angle to the horizontal greater than the putter shaft lie angle.

U.S. Pat. No. 5,024,442 is similar to U.S. Pat. No. 4,453,717 in providing a guide surface for the heel of the putter at a fixed but unspecified angle. U.S. Pat. No. 5,024,442 also has a surface with a vertical face for practicing a putter stroke along the line of the putt.

Accordingly, the present invention provides a golf putting practice aid comprising a guide having at least one guide surface with which one or the other of a heel or toe of a putter makes contact in use, which guide surface is positioned to extend upwardly from a substantially planar base or ground surface, and whereas the guide surface is straight throughout its length and is inclined towards the player from said planar base or ground surface, and wherein the guide is substantially planar and provides two guide surfaces to oppose sides thereof, and wherein, inuse, the user selects whether to engage the head or the toe of the putter with a respective one of the guide surfaces.

Preferably the angle of the guide surface is adjustable. Preferably the guide surface is planar over the area contacted by the putter head in use. The inclined guide surface is used to constrain the putter to follow an inclined plane angled towards the player.

One of the two guide surfaces, in use, faces towards the user for contact with a toe of the putter, and another in use, faces away from the user for contact with the heel of the putter. Said one guide surface and said another guide surface are formed on the opposite sides of an upstanding guide plate. The user selects which of the guide surfaces is to be used, i.e. whether the heel or the toe of the putter is to be guided. The guide surface for the toe of the putter can be used for all types of putter whilst the guide surface for the heel can be used for most types of putter. The adjustable nature of the guide and hence the guide surface enables the player to select any preferred angle of inclination, which for most players is recommended to be the angle from the ball to the shoulders. There is no teaching of this in the prior art. Any angle up to perpendicular to the base could be set. Usually the angle will be between 0° and 20° and most usually this angle will be between 5° and 15° to the vertical and usually this angle will be less than the lie angle of the putter shaft to the vertical. In particular, the rules of golf do not permit the lie of the putter shaft to the vertical to be less than 10°. It will be appreciated that a custom built guide fixed at a chosen angle for a particular player could be provided.

The aid preferably incorporates a base, although it will be appreciated that the inclined guide could be provided with means by which it is directly engaged with a playing surface. However, it is preferred that the apparatus incorporate a base plate which is substantially planar and from which the guide surface extends upwardly. The guide surface may extend from one edge of the base plate, but more preferably it extends from a position intermediate its opposite edges so that it might be used for guiding either the toe or the heel of the putter according to player preferences. It is preferred that the base carries markings to aid putter alignment. A first set of markings comprise a plurality of lines indicating the correct alignment of the putter face during the putting stroke. The angle of these can be calculated mathematically or they can be arrived at from a physical model. A second set of lines are in line with the direction of the putt. A further preferred marking is a curve on the guide surface to indicate the correct putter path along the guide surface. One set of markings for putter face alignment and one curve on the guide surface may be provided for typical player preferences. Alternatively several sets of markings could be provided for different preferences with the markings for each preference being distinguished from the others by being in a different color or by other suitable means.

In one embodiment, the base comprises a peripheral framework surrounding a putting surface, preferably comprising the aforesaid markings. The framework comprises four corner connectors, and interconnecting elongate frame elements. A pivot block interconnects end frame elements intermediate the corner connectors and receives a pivot connection of a guide holder. Opposite ends of the guide are received in a respective guide holder.

Any convenient method of adjusting the guide and hence each guide surface may be used. It is preferred that the angle of the guide surface be adjustable throughout the range 0° to 90° to the vertical to allow the player to select any chosen angle and to allow the guide surface to lie on the base for easy storage of the guide. The guide can be made of any convenient material, but I prefer plastics. Preferably the base is covered with baize or felt or other suitable material to simulate a putting green. The guide surface could be rectangular, or any other convenient shape, but preferably the top edge of the guide surface is curved so as to reduce the distance from the path of the putter along the guide surface to the top of the guide surface. For suitable types of putter design, this will prevent the putter shaft contacting the top of the guide when the heel of the putter is engaged with the guide. It also reduces the extent to which the guide surface obscures the base, although preferably the guide surface is made from clear plastics.

BRIEF DESCRIPTION OF THE DRAWINGS

The present invention will now be described further by way of example only with reference to the accompanying drawings in which.

DETAILED DESCRIPTION OF THE INVENTION

Figure 1:
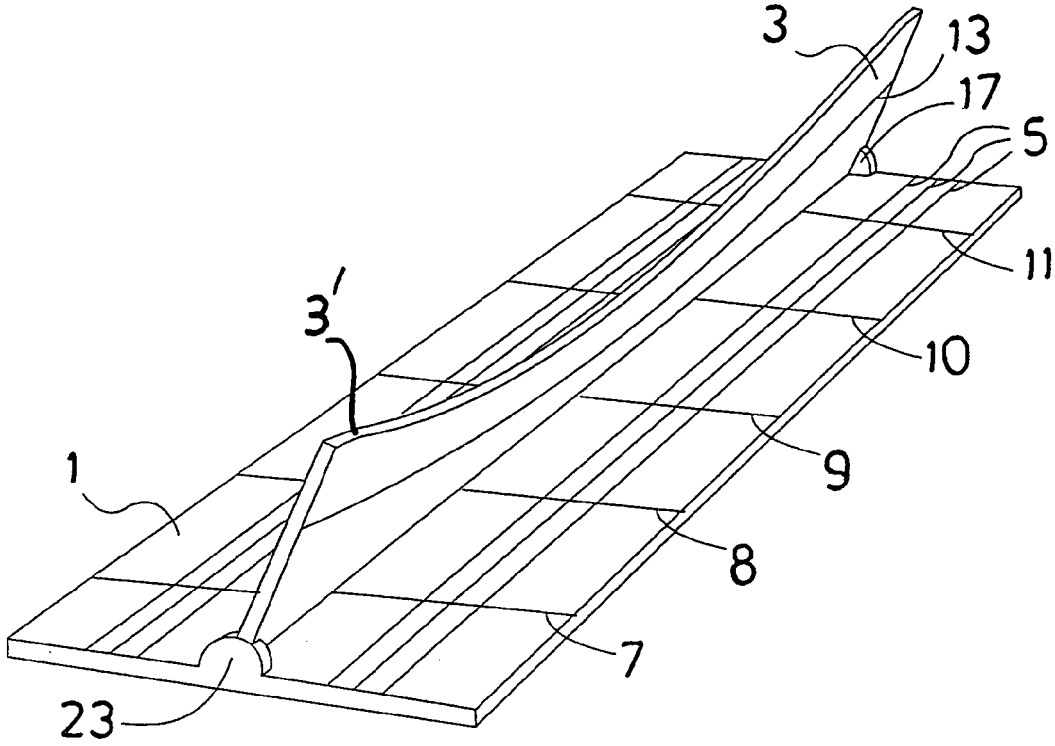
FIG. 1 is a perspective view of one embodiment of putting aid according to the present invention.

Referring to the drawing of FIG. 1, a golf putting practice aid according to the present invention comprises a base 1 which is substantially planar and from which a plate-like element 3' extends upwardly at an angle which is inclined to the perpendicular with respect to the base. The guide plate 3' has a planar guide surface 3 on the right hand side and an identical parallel planar guide surface on the left hand side. The guide plate is connected to the base using mounting blocks 17 and 23. The guide plate divides the base into two halves and in the illustrated embodiment both halves are provided with markings described further hereinafter. In the illustrated embodiment, in use, the right hand edge of the base is positioned facing towards the user and with the right hand edge which is parallel to the bottom edge of the guide surface 3 disposed parallel to the direction of the intended putt. Three parallel lines 5 are marked on the base and are also parallel to the intended putt direction. The base also carries five lines 7 through 11 which are disposed approximately at right angles to the direction of the putt and indicate the correct alignment of the putter face during the putting stroke. The proper alignment is the horizontal component of the line of the putter face for a putting stroke consisting solely of a rotation about a fixed axis of rotation. The middle line 9 gives the correct alignment at impact and is, of course, exactly perpendicular to the line of the putt. The other four lines are angled slightly away from the perpendicular. The precise alignment depends on the position and direction of the axis of rotation for the putting style of the player and can be calculated by geometry for any chosen axis of rotation. It strictly also depends on the angle of the putter head to the ground at address, although usually the putter head at address will be horizontal, i.e. parallel to the ground. The recommended putting style is for the axis of rotation (20' on FIG. 3) to be perpendicular to the line from the ball to the shoulders (and perpendicular to the line of the putt). Alternatively, the orientation of these lines can be arrived at from a physical model.

Figure 3:
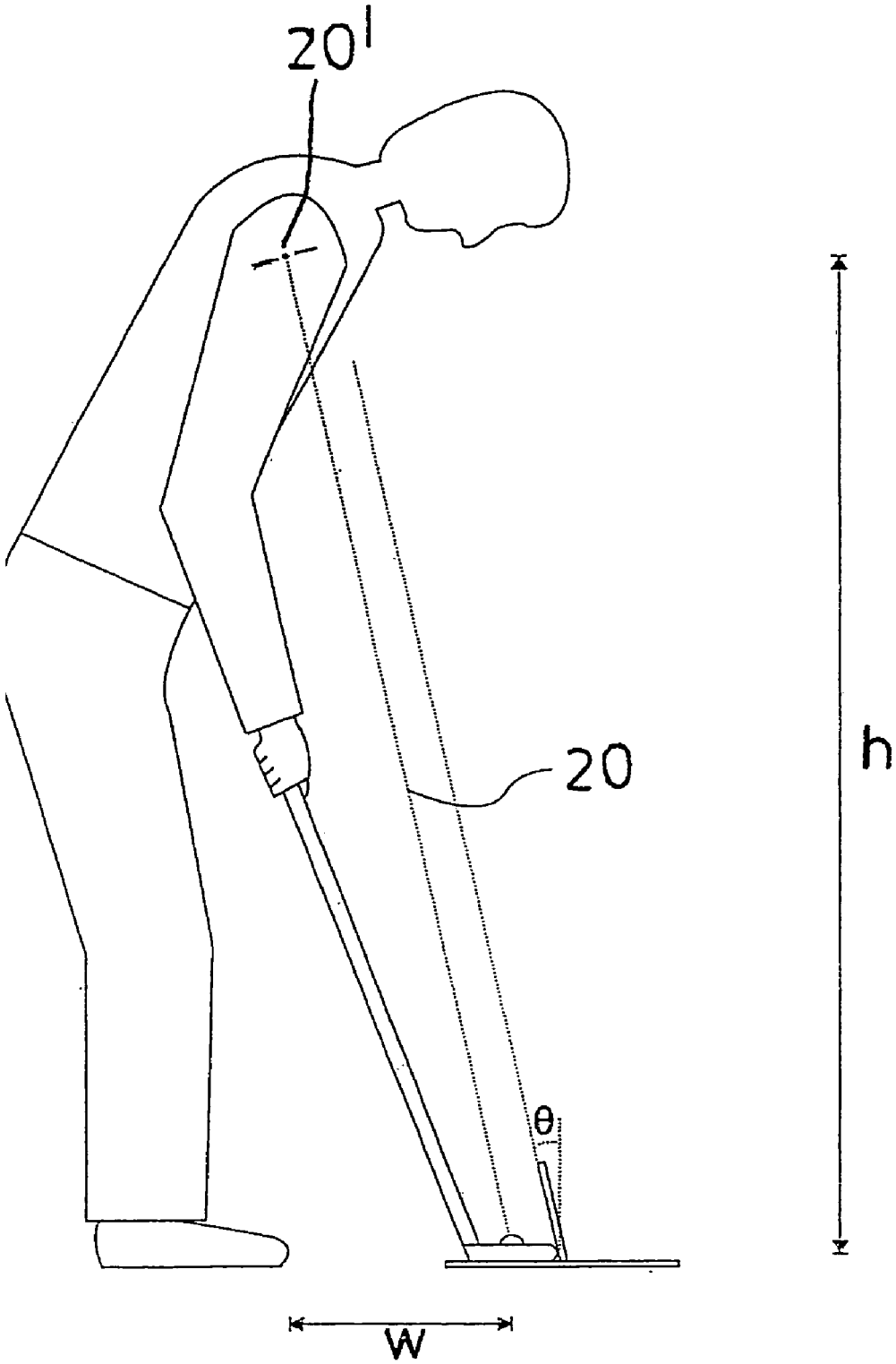
FIG. 3 is a diagrammatic view looking along the line of the putt, of a player addressing a ball.
Figure 4:
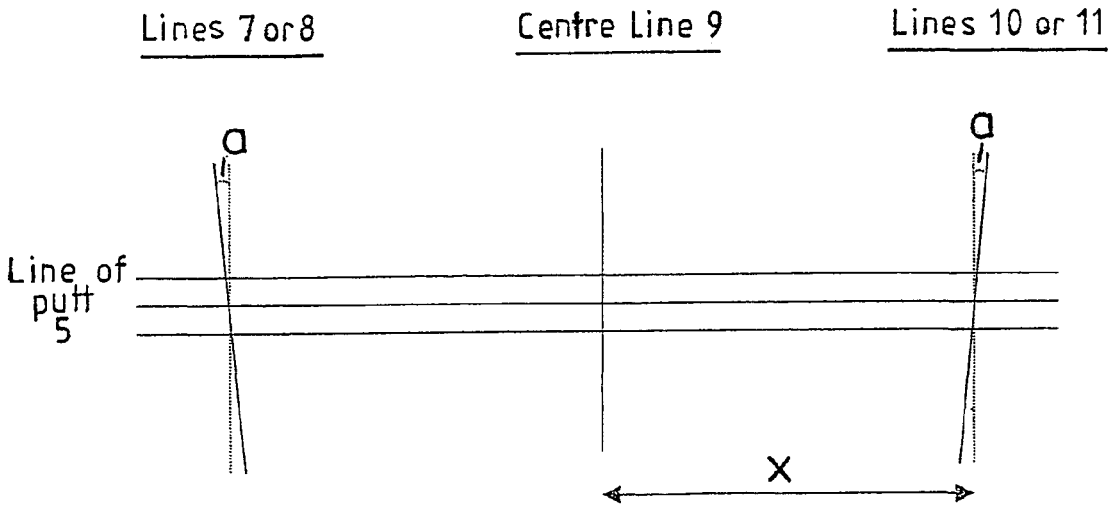
FIG. 4 illustrates the angle α and the distance x.
Figure 5:
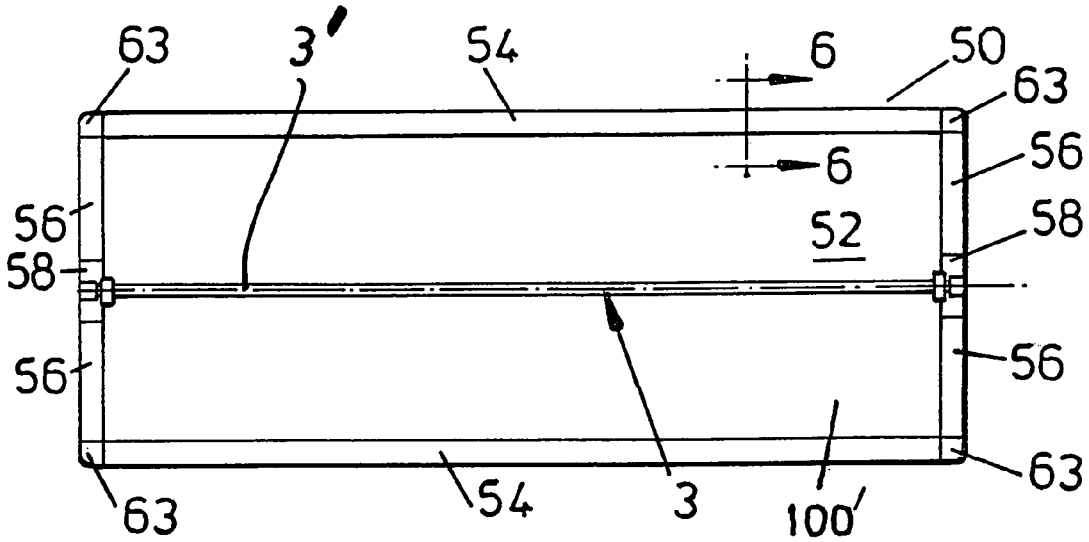
FIG. 5 is a plan view of another embodiment of the apparatus.
Figure 7:
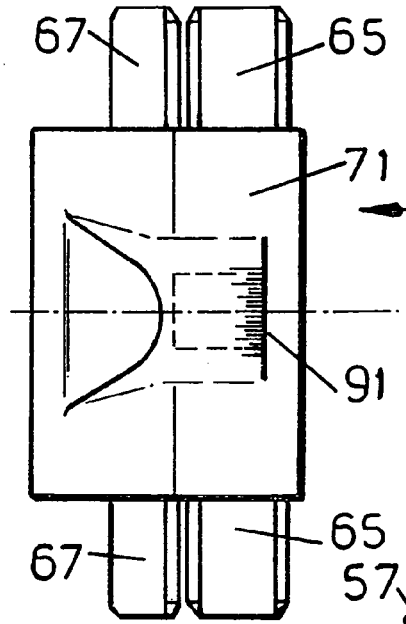
FIG. 7 is a plan view of a pivot block used in the embodiment of FIG. 5.

In FIG. 3 the dotted line 20 is the line from the ball to the player's shoulders and the guide surface is aligned parallel to this line (the recommended alignment). The angle of inclination of the guide surface with respect to the vertical 0 will usually be between 5° and 20°. Also shown are the horizontal and vertical distances w and h from the ball to the physical center of rotation of the stroke (through which the axis of rotation passes) which are used in calculating the angle α of the lines 7, 8 10 or 11 at any distance x. The angle α is shown in FIG. 4, as is the distance x. Most usually w and h will be the distances from the ball to the player's shoulders consistent with swinging the putter from the shoulders. Exceptionally w and h could be the distances to the player's wrists where the player prefers to swing the putter from the wrists. A line 13 is marked on one or both sides of the guide surface to indicate the correct path of the putter along the guide surface. This line is a section of a circle of radius equal to the shortest distance from the ball at address to the axis of rotation. For a general-purpose guide all but the middle line 9 may be omitted.

In the embodiment as illustrated in FIG. 1 the guide can be used by either right or left handed players. In use a player stands with his putter face aligned with line 9 and with the toe contacting the inclined guide surface 3 of the plate-like element 3'. During the back swing the putter toe continues to contact the guide surface and is caused thereby to swing the putter head in the plane defined by the guide surface. By practicing in this way the player can train himself to replicate this swing when the putting aid is removed.

If it was desired to constrain the movement of the heel rather than the toe this can be accommodated with the illustrated device by using the planar guide surface on the left-hand side of the guide plate. If used to constrain the heel, the markings on the left hand side of the guide plate, which are the same as those on the right hand side, indicate the alignment of the putter face. I anticipate a guide length of approximately 90 cm and base width of approximately 30 cm to be sufficient and for the guide height to be of the order of 15 cm at the ends.

Figure 2:
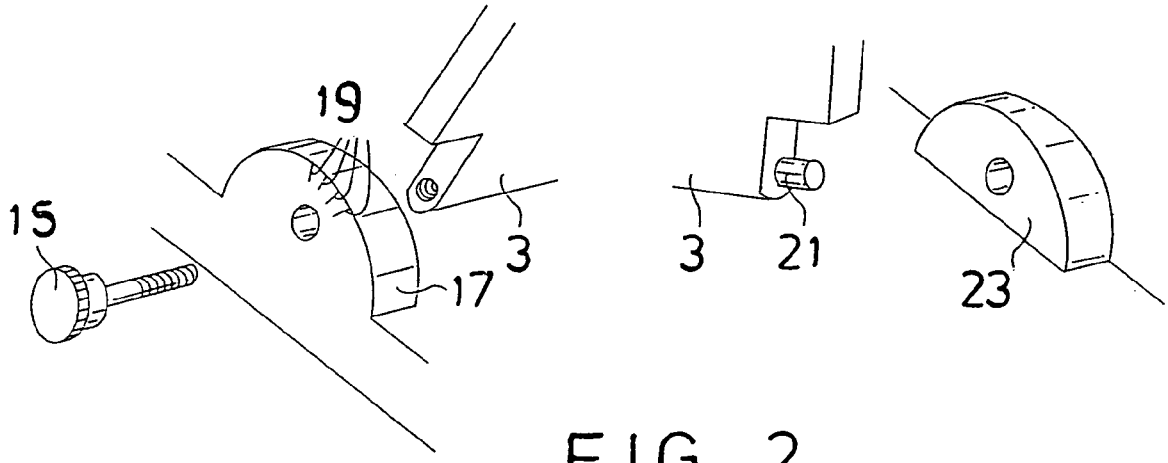
FIG. 2 is an exploded view showing one possible means of adjusting the angle of the guide surface.

Referring now to FIG. 2 here we show one example of how the guide plate 3 might be rendered adjustable with respect to the base. In this embodiment the screw 15 passes through a hole in the mounting block 17 and screws into the guide plate 3'. By tightening the screw against the end face of the mounting block the guide plate can be locked in any desired angle. The mounting block is provided with markings 19 to give a reference for the position of the guide plate. At the opposite end of the guide plate a protruding pivot rod 21 fits into a hole in the mounting block 23 at the opposite end of the base. The apparatus can be made from any suitable material including metal, wood or plastics.

Referring now to FIGS. 5 to 13 there is illustrated another embodiment of apparatus according to the invention. The apparatus comprises a base 100' and adjustable guide 3'. The guide 3' is substantially the same as the guide described and illustrated with respect to FIG. 1 in that it comprises a substantially planar element. The means for mounting it for pivotal movement differs and is described in further detail hereinafter. The guide is shown upright in FIG. 5 for ease of illustration. The base 100' comprises a peripheral rectangular frame 50 infilled with a rectangular element 52. The rectangular element conveniently comprises a removable mat. Preferably the mat is made from a sheet of foam having a layer of felt secured to one side to form the upper surface of the mat. The mat preferably carries markings as previously discussed for base 1.

Figure 6:
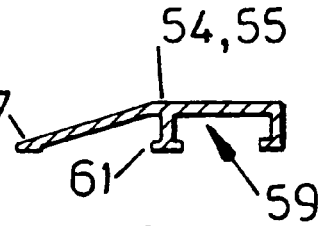
FIG. 6 is a sectional view taken on 6—6 of frame elements of the apparatus of FIG. 5.
Figure 8:
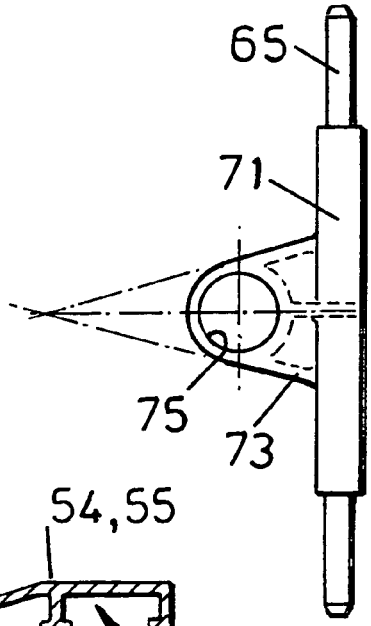
FIG. 8 is a view on A of FIG. 7.

The frame 50 is made up of four corner connectors 63, two long elongate elements 54, four short elongate elements 56 and two pivot blocks 58. The section of the elongate elements 54 and 56 is represented by FIG. 6 and has a downward chamfer leading the outside peripheral edge 57. An intermediate rib 61 of the elongate section defines to one side thereof a reception portion 59 of generally inverted U-shaped configuration. The reception portion is open to the under side (but could be closed) and open to each of the opposite ends of the elongate section.

Figure 10:
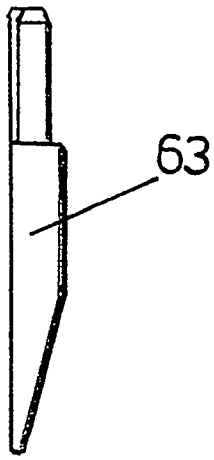
FIG. 10 is a view on B of FIG. 9, FIGS. 11, 12 and 13 are end, side and opposite end views of a guide holder as used in the embodiment of FIG. 5.
Figure 9:
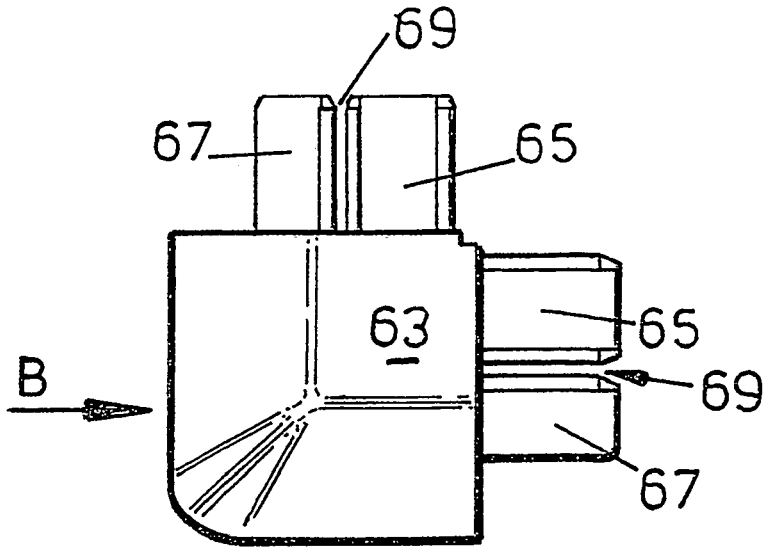
FIG. 9 is a plan view of a corner connector as used in the embodiment of FIG. 5.
Figure 11:
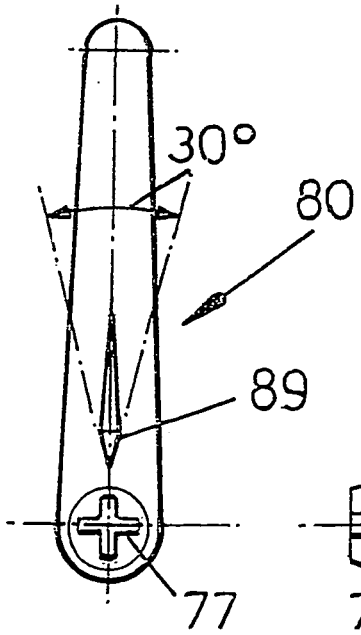
Figure 12:
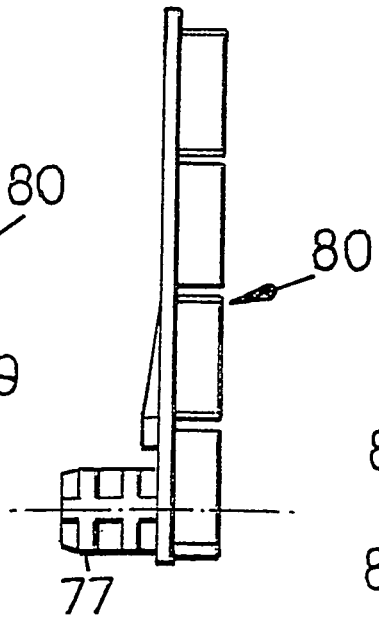
Figure 13:
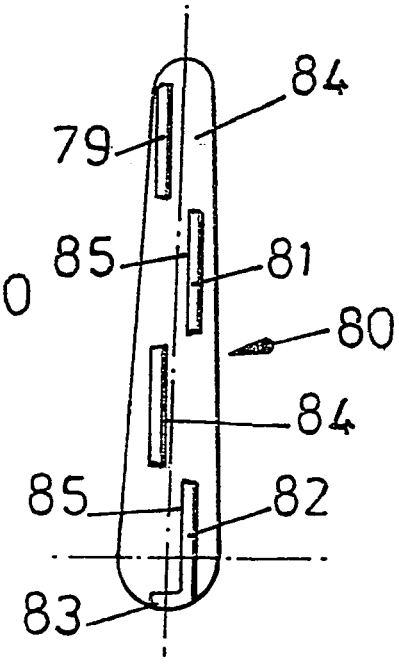

The corner connections 63 are shown in FIGS. 9 and 10 and comprises a body portion 63 which has a section with a chamfer to suit the section of the elongate elements. Two connecting prongs 65, 67 depend from sides of the body set 90° to one another. The prong 65 is dimensioned to be received in the reception bore 59. A gap 69 between the two prongs 65, 67 receives the rib 61. By this means elongate elements 54 and 56 are located at 90° to one another. Two short elongate elements 56 are connected together by a pivot block 58 described in further detail with reference to FIGS. 7 and 8. Each pivot block 58 comprises a body 71 having pairs of prongs 65 and 67 to opposite sides thereof to receive an end of a respecting elongate member 56 in the same manner as the corner connectors. The body has an upstand 73 which has a bore 75 to receive a pin 77 of a guide holder 80 described further with reference to FIGS. 11 to 13. The guide holder comprises an elongate body having the pin 77 projecting to one side from one end. The other side is provided with a plurality of lugs 79, 80, 81, 82 (four in the illustrated embodiment). Two of the lugs 79, 80 are mounted so that they have abutment faces 84 set in a line and spaced from the opposed aligned abutment surfaces 85 of the lugs 81, 82. The space between the abutment surfaces receives the end of the planar guide 3'. The lower most lug 82 has a stop 83 for a lower edge of the guide 3'. Providing a respective guide holder to opposite ends of the guide 3' enables the guide to be mounted for pivotal movements with respect to the base. The guide holders have a marker 89 which is used in conjunction with markings 91 on the pivot body to assist with setting the guide to the desired angle. The pin 77 is a frictional fit in the bore 75.

What is claimed is:

1. A golf pulling practice aid for use by a player making a stroke with a putter having a face, heel and toe, the golf putting practice aid comprising a guide positioned to extend upwardly from a substantially planar surface, the guide being substantially planar and providing two guide surfaces on opposite faces thereof, the guide surfaces being straight throughout their length inclined towards the player from the substantially planar surface by at least one angle, wherein at least one angle of the guide surfaces is adjustable and a screw locks the guide against an end face of a mounting block to adjust the at least one angle of the guide surfaces, and wherein, in use, the player selects whether to engage the heel or toe of the putter with a respective one of the guide surfaces.

2. A golf putting practice aid as claimed in claim 1, wherein the mounting block has markings that the player can use as a reference to set the at least one angle.

3. A golf putting practice aid for use by a player making a stroke with a putter having a face, heel and toe, the golf putting practice aid comprising a guide positioned to extend upwardly from a substantially planar surface, the guide being substantially planar and providing two guide surfaces on opposite faces thereof, the guide surfaces being straight throughout their length, inclined towards the player from the substantially planar surface by at least one angle and having at least one curved marking comprising part of a circle to indicate a preferred path of the putter head along the guide surfaces, and wherein, in use, the player selects whether to engage the heel or toe of the putter with a respective one of the guide surfaces.

4. A golf putting practice aid as claimed in claim 3, wherein the substantially planar surface is provided by a base.

5. A golf putting practice aid as claimed in claim 4, in which the base comprises a peripheral framework to which the guide is mounted.

6. A golf putting practice aid as claimed in claim 5, in which the framework is infilled with a putting surface.

7. A golf putting practice aid as claimed in claim 6, in which the putting surface comprises a removable mat.

8. A golf putting practice aid as claimed in claim 5, in which the framework is molded from plastic in a plurality of sections that are interconnectible.

9. A golf putting practice aid as claimed in claim 3, further including a base which extends to both sides of the guide.

10. A golf putting practice aid as claimed in claim 9, wherein the base has a set of lines parallel to a bottom edge of the respective guide surface to indicate the direction of the putt and the lines are on the base on opposite sides of the guide.

11. A golf putting practice aid as claimed in claim 9, in which the base contains at least one set of lines to indicate the correct alignment of the putter face during the stroke, the base has the lines on opposite sides of the guide and the lines that indicate correct alignment of the putter face are those for a putting stroke consisting solely of a rotation about a fixed axis of rotation using chosen values for the position and direction of the axis of rotation and the angle of the putter head to the ground at address.

12. A golf pulling practice aid as claimed in claim 3, in which the guide is a transparent sheet.

13. A golf pulling practice aid as claimed in claim 3, wherein the substantially planar surface is a ground surface.

14. A golf pulling practice aid as claimed in claim 3, wherein the substantially planar surface is chosen from the group consisting of a base and a ground surface.

15. A golf putting practice aid for use by a player making a stroke with a putter having a face, heel and toe, the golf putting practice aid comprising a guide positioned to extend upwardly from a substantially planar surface provided by a base, the guide being substantially planar and providing two guide surfaces on opposite faces thereof, the guide surfaces being straight throughout their length and inclined towards the player from the substantially planar surface by at least one angle, wherein the base contains at least one set of lines to indicate correct alignment of the putter face during the stroke, the lines being for a putting stroke consisting solely of a rotation about a fixed axis of rotation using chosen values for the position and direction of the axis of rotation and the angle of the putter head to the ground at address, and wherein, in use, the player selects whether to engage the heel or toe of the putter with a respective one of the guide surfaces, wherein the guide surfaces have at least one curved marking comprising part of a circle to indicate a preferred path of the putter head along the guide surfaces.

16. A golf putting practice aid for use by a player making a stroke with a putter having a face, heel and toe, the golf putting practice aid comprising a guide positioned to extend upwardly from a substantially planar surface provided by a base, the guide being substantially planar and providing two guide surfaces on opposite faces thereof, the guide surfaces are straight throughout their length and are inclined towards the player from the substantially planar surface by at least one angle, wherein the base has a set of lines parallel to a bottom edge of the respective guide surface to indicate the direction of the putt and the lines are on the base on opposite sides of the guide, and wherein, in use, the player selects whether to engage the heel or toe of the putter with a respective one of the guide surfaces.

17. A golf putting practice aid for use by a player making a stroke with a putter having a face, heel and toe, the golf putting aid comprising a guide positioned to extend upwardly from a substantially planar surface, the guide providing at least one guide surface with which one or other of the heel or toe of the putter makes contact, in use, wherein the at least one guide surface has at least one curved marking comprising part of a circle to indicate a preferred path of the putter head along the guide surface, and wherein, in use, the player selects whether to engage the heel or toe of the putter with at least one guide surface.

* * * * *

UNITED STATES PATENT AND TRADEMARK OFFICE

CERTIFICATE OF CORRECTION

PATENT NO. : 7,217,198 B2
APPLICATION NO. : 10/333047
DATED : May 15, 2007
INVENTOR(S) : Roger T. Brooks It is certified that error appears in the above-identified patent and that said Letters Patent is hereby corrected as shown below:

Column 4, line 38, “O” should be --Θ--.

Column 7:

Line 1 (claim 12, line 1), “pulling” should be --putting--.
Line 3 (claim 13, line 1), “pulling” should be --putting--.
Line 5 (claim 14, line 1), “pulling” should be --putting--.

Signed and Sealed this

Seventeenth Day of February, 2009

JOHN DOLL
*Acting Director of the United States Patent and Trademark Office*